US008720743B2

(12) United States Patent
Smalley et al.

(10) Patent No.: US 8,720,743 B2
(45) Date of Patent: May 13, 2014

(54) DISPENSING PACKAGE

(75) Inventors: Brian Leslie Smalley, Bristol (GB); Zoe Wilkins, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 1135 days.

(21) Appl. No.: 10/523,887

(22) PCT Filed: Jul. 31, 2003

(86) PCT No.: PCT/GB03/03351

§ 371 (c)(1),
(2), (4) Date: Sep. 6, 2005

(87) PCT Pub. No.: WO2004/014755

PCT Pub. Date: Feb. 19, 2004

(65) Prior Publication Data

US 2006/0249529 A1 Nov. 9, 2006

(30) Foreign Application Priority Data

Aug. 8, 2002 (GB) ..... 0218392.9

(51) Int. Cl.
*A47F 1/04* (2006.01)

(52) U.S. Cl.
USPC ..... 221/309; 221/304; 221/303; 221/305; 229/100; 229/120.02; 229/122.1

(58) Field of Classification Search
USPC ..... 221/1–312 C; 220/532; 206/427; 229/120.02, 120.05, 120.06, 120.18, 229/120.21, 120.32, 121, 122, 122.21, 242
See application file for complete search history.

(56) References Cited

U.S. PATENT DOCUMENTS

| | | | | | |
|---|---|---|---|---|---|
| 2,928,539 | A | | 3/1960 | Chirchiglia | |
| 3,265,283 | A | * | 8/1966 | Farquhar | 229/221 |
| 3,300,115 | A | * | 1/1967 | Schauer | 221/305 |
| 3,356,279 | A | * | 12/1967 | Root | 206/427 |
| 4,170,325 | A | * | 10/1979 | Pawlowski et al. | 206/526 |
| 4,235,158 | A | * | 11/1980 | Johnson, Jr. | 493/334 |
| 4,364,509 | A | | 12/1982 | Holley et al. | |
| 4,396,143 | A | | 8/1983 | Killy | |
| 4,752,029 | A | * | 6/1988 | Buford | 229/122.1 |
| 4,958,734 | A | | 9/1990 | Wood et al. | |
| 5,368,194 | A | * | 11/1994 | Oliff et al. | 221/305 |
| 5,427,242 | A | * | 6/1995 | Oliff et al. | 206/430 |
| 5,516,037 | A | | 5/1996 | Okamoto et al. | |
| 5,518,111 | A | * | 5/1996 | Stout | 206/160 |
| 5,669,500 | A | * | 9/1997 | Sutherland | 206/427 |

(Continued)

FOREIGN PATENT DOCUMENTS

| | | |
|---|---|---|
| JP | 7-315375 | 5/1995 |
| JP | 9-502147 | 3/1997 |

(Continued)

*Primary Examiner* — Michael K Collins
(74) *Attorney, Agent, or Firm* — Womble Carlyle Sandridge & Rice, LLP

(57) ABSTRACT

A paperboard carton for receiving articles in two or more layers separated by a divider pad is provided. The divider pad is secured relative to an end panel arrangement at one end of the carton. The carton has a top panel, a base panel and a pair of opposite sides. One of the side panels has a removable portion adjacent one end, which, when removed, defines a roll out aperture for article removal when the carton is lying on the end panel arrangement.

23 Claims, 6 Drawing Sheets

(56) References Cited

U.S. PATENT DOCUMENTS

| | | | | |
|---|---|---|---|---|
| 5,878,947 | A * | 3/1999 | Hoy et al. | 229/122.1 |
| 6,062,424 | A | 5/2000 | Simile-Gravina et al. | |
| 6,176,419 | B1 * | 1/2001 | Holley, Jr. | 229/122.1 |
| 6,604,677 | B1 | 8/2003 | Sutherland et al. | |
| 6,923,365 | B2 * | 8/2005 | Auclair et al. | 229/120.011 |
| 6,929,172 | B2 * | 8/2005 | Bates et al. | 229/244 |
| 6,991,107 | B2 * | 1/2006 | Harrelson | 206/427 |
| 7,000,803 | B2 * | 2/2006 | Miller | 221/302 |
| 7,168,558 | B2 * | 1/2007 | Harrelson | 206/170 |
| 7,175,047 | B2 | 2/2007 | Spivey | |
| 7,413,101 | B2 * | 8/2008 | Smalley et al. | 221/309 |
| 2005/0103650 | A1 | 5/2005 | Auclair | |
| 2006/0249529 | A1 | 11/2006 | Smalley et al. | |

FOREIGN PATENT DOCUMENTS

| | | |
|---|---|---|
| JP | 2004-527010 | 9/2004 |
| WO | WO 95/06425 | 3/1995 |
| WO | WO 02/14166 | 2/2002 |

* cited by examiner

DISPENSING PACKAGE

This application claims priority under 35 U.S.C. §119(b) to British application serial no. 0218392.9, filed on Aug. 8, 2002, and PCT application serial no. PCT/GB03/03351, filed on Jul. 31, 2003, under 35 U.S.C. §363, the contents of which are hereby incorporated in their entirety as if repeated herein.

BACKGROUND OF THE INVENTION

The present invention relates to dispensing packages and more particularly, but not exclusively, those for canned products such as food and drink.

SUMMARY OF THE INVENTION

Commonly, canned food/drink products are supplied in a shallow tray made of paperboard or corrugated board, with a shrink wrapping of plastic film. A number of these shrink wrapped trays are often stacked one above the other on a supermarket shelf. The trays are usually stacked on their widest surface which can be considered as lacking space efficiency, particularly if only one tray is on the shelf. Additionally the shrink wrap is not good for assisting in product differentation.

According to the present invention there is provided a paperboard carton for articles arranged in at least two layers, the carton having a top panel, a base panel, a pair of oppositely disposed side panels and a pair of oppositely disposed end panel arrangements, a divider pad being provided between the adjacent layers of articles and being secured relative to the end panel arrangement at one end, one of the side panels having a removable portion adjacent said one end so as to define a roll-out aperture for article removal when the carton is lying on said one end panel arrangement.

Preferably the divider pad is secured relative to the other end panel arrangement. Conveniently each end panel arrangement comprises a pair of oppositely disposed side end flaps hingedly connected to the side panels and a pair of oppositely disposed main end flaps hingedly connected to the top and base panels respectively.

In preferred embodiments the divider pad has a fold down gluing panel at the or each secured end. With a preferred arrangement the top end flap is folded down last and is adhesively secured to all its associated end flaps of its associated end panel arrangement and to its associated fold down gluing panel.

Ideally a single straight glue line effects said adhesive attachment of the top end flap to the other end flaps and gluing panel. In one such embodiment the base end flap has a central projecting area such that the straight glue line is provided in turn on one of the side end flaps, the gluing panel, the central area of the base end flaps, the gluing panel and the other side end flap.

In further preferred embodiments said removable portion extends into the top and base panels to aid removal of the articles and also said removable portion is defined by perforations or other lines of weakening.

Normally, the top panel base panel, two side and two end panel arrangement panels are substantially rectangular but other arrangements could be envisaged.

With preferred arrangements one or more cuts extend partway to the adjacent end from the removable portion. Conveniently two of said cuts extend along the folds between said one side panel and the top and base panels respectively and also a transverse cut is provided at the end of the or each cut remote from the removable portion.

Embodiments of the present invention will now be described in more detail. The description makes reference to the accompanying drawings in which:

DETAILED DESCRIPTION

Figure 1:
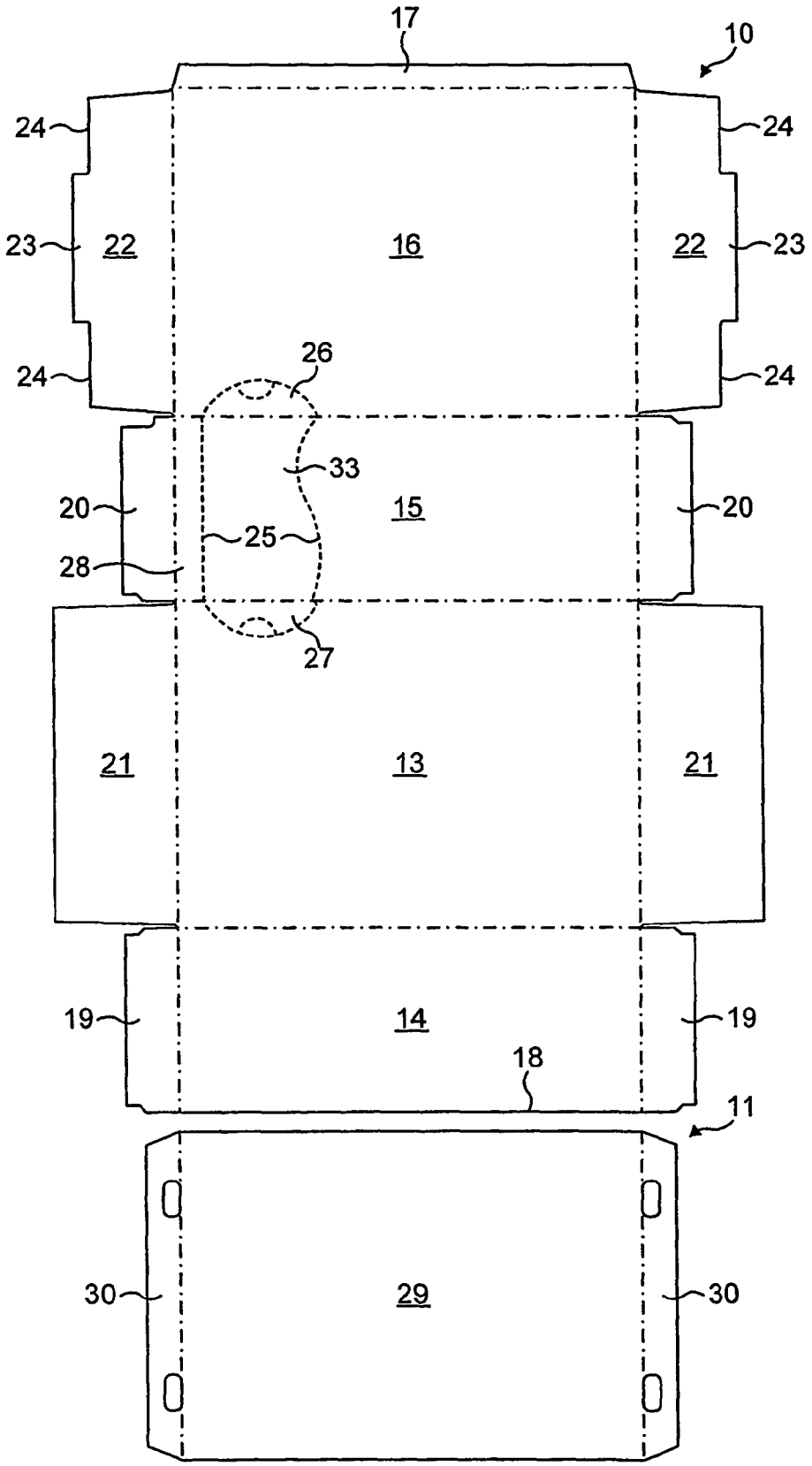
FIG. 1 shows two paperboard blanks for producing a carton according to the present invention.
Figure 6:
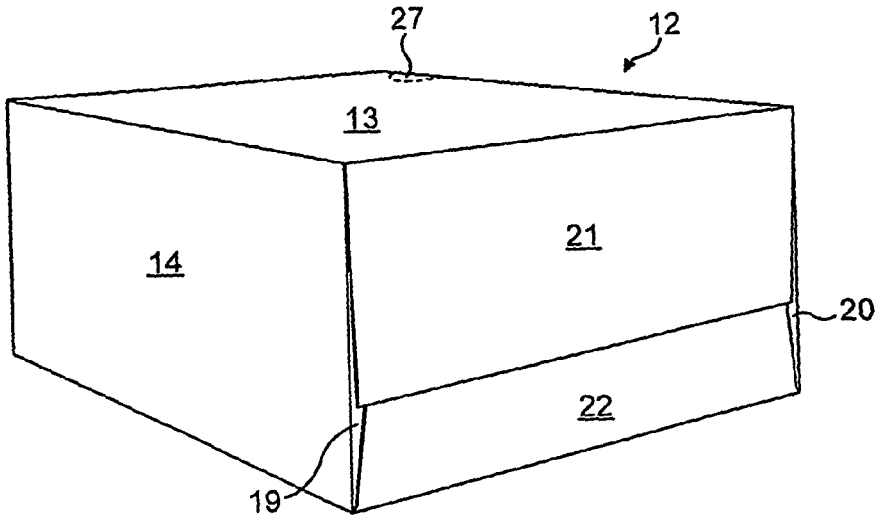
Figure 7:
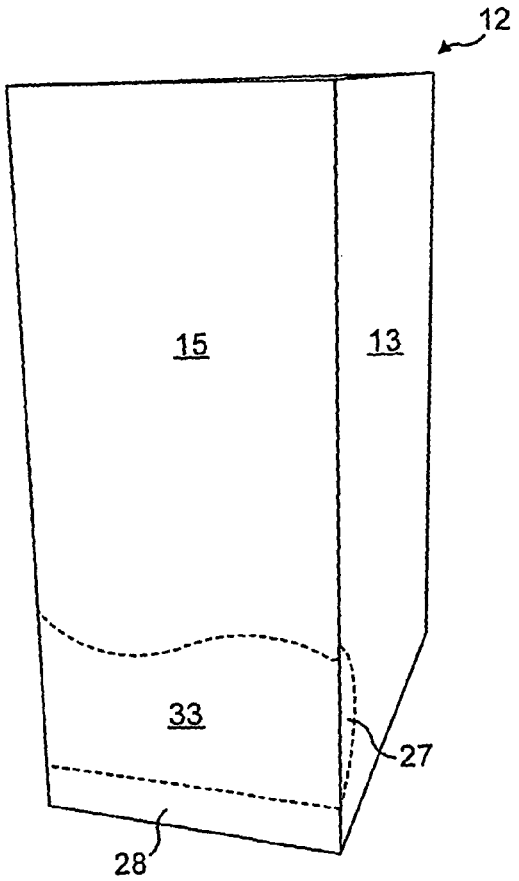
FIG. 7 is a side perspective view of the assembled carton standing on one end.

In FIG. 1 there is shown a pair of paperboard blanks 10, 11 for producing a carton 12 which is shown in FIG. 7 in an assembled condition standing on one end. The various stages of assembly are illustrated in perspective in FIGS. 2 to 6.

The main blank 10 is used to form the basic carton shape and provides a top panel 13 hingedly connected to oppositely disposed side panels 14, 15. Side panel 15 is in turn hingedly connected to a base panel 16 which is hingedly connected to an adhesive flap 17. The main blank 10 is formed into a general sleeve shape by adhering the adhesive flap 17 to the area adjacent the free edge 18 of the side panel 14.

Side end flaps 19, 20 are hingedly connected to side panels 14, 15 respectively at each end of the blank 10. A top end flap 21 is hingedly connected to the top panel 13 at each end and similarly a base end flap 22 is hingedly connected to the base panel 16 at each end of the blank 10. Each base end flap 22 has a central area 23 which projects beyond the adjacent free edges 24 of the base end flap 22 and the reason for this will be clarified later.

Side panel 15 also incorporates a removable portion 33 defined by lines of weakening 25 such as perforations. The removable portion 33 extends partially at 26 into the base panel 16 and at 27 into the top panel 13. A small portion 28 of the side panel 15 is intended to remain after the removable portion 33 has been removed thereby to act as a stop wall. Other forms and shapes of roll-out feature could also be substituted for the illustrated one.

The second blank 11, a divider pad, comprises a rectangular main panel 29 which corresponds in size and shape to the top and base panels 13, 16 of the main blank 10. At each end of the main panel 29 a fold-down glue panel 30 is hingedly connected.

Figure 2:
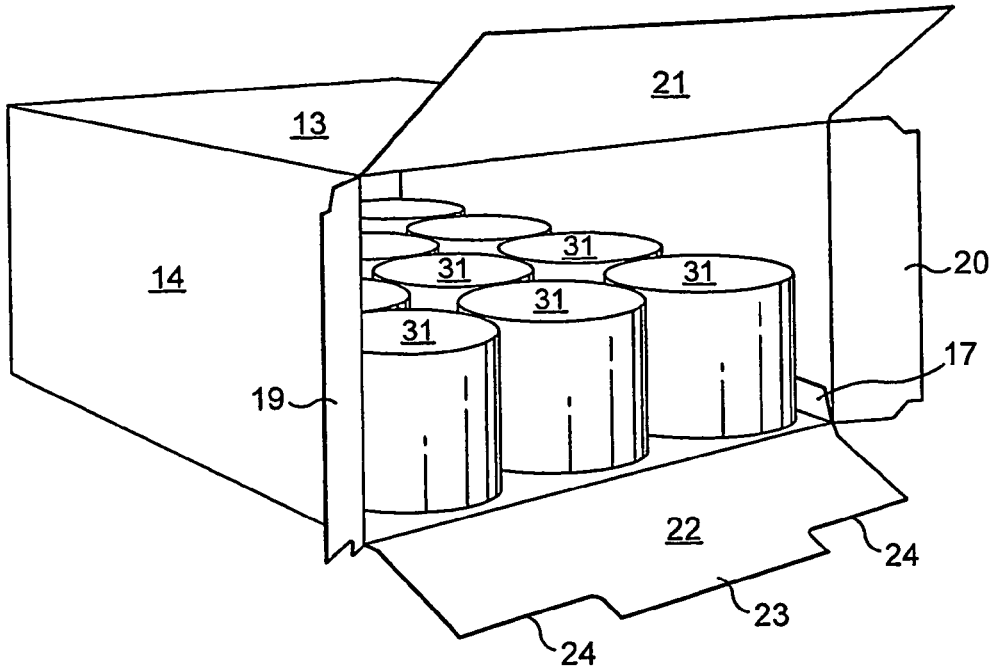
FIGS. 2 to 6 are end perspective views showing the stages of assembly of the blanks of FIG. 1 to form the carton according to the present invention.
Figure 3:
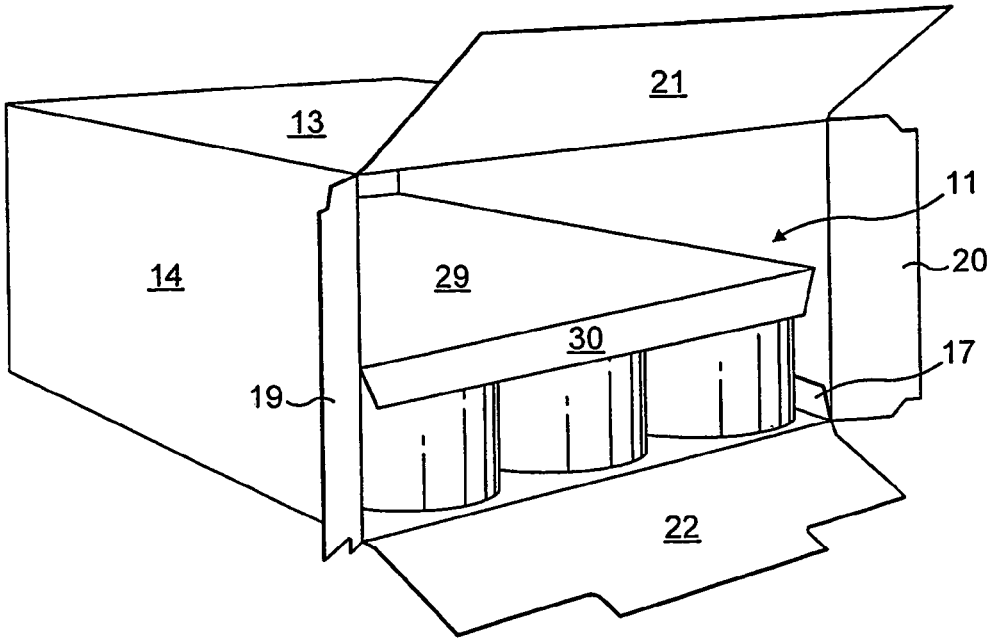
Figure 4:
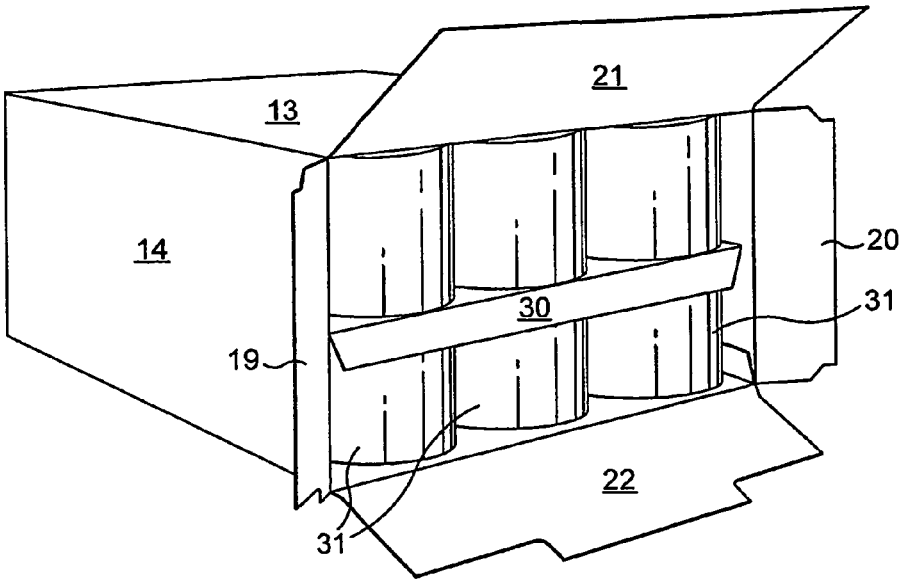
Figure 5:
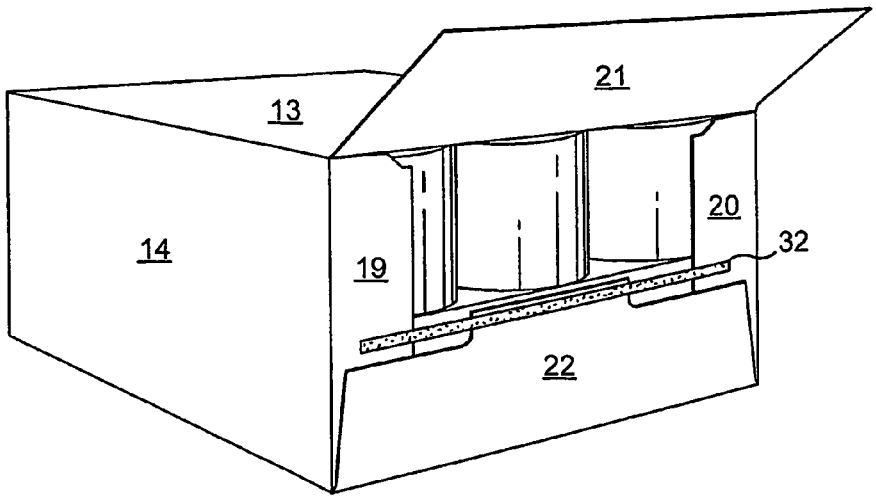

To assemble the carton 12 the adhesive flap 17 of the main blank 10 is secured to the side panel 14 and the main blank 10 is opened up to form an open-ended sleeve. A layer of cans 31 are then inserted into the sleeve so as to have their ends lying on the base panel 16 as shown in FIG. 2. The second blank 11 is then inserted as shown in FIG. 3 so as to lie on top of the layer of cans 31. A second layer of cans 31 is then inserted into the sleeve so as to lie on top of the main panel 29 of the divider pad 11 with the glue panels 30 folded down at both ends of the sleeve so as to lie against the lower layer of cans 31, as shown in FIG. 4. The side end flaps 19, 20 at each end are then folded in and the base end flaps 22 are folded up and at each end a single straight glue line 32 is applied to the side end flaps 19, 20, the glue panel 30 and to the central area 23 of the base end flap 22 as shown in FIG. 5. The top end flap 21 at each end is then folded down into contact with the glue line 32 so as to be adhesively secured to the glue panel 30, the base end flap 22 and the side end flaps 19, 20.

Figure 8:
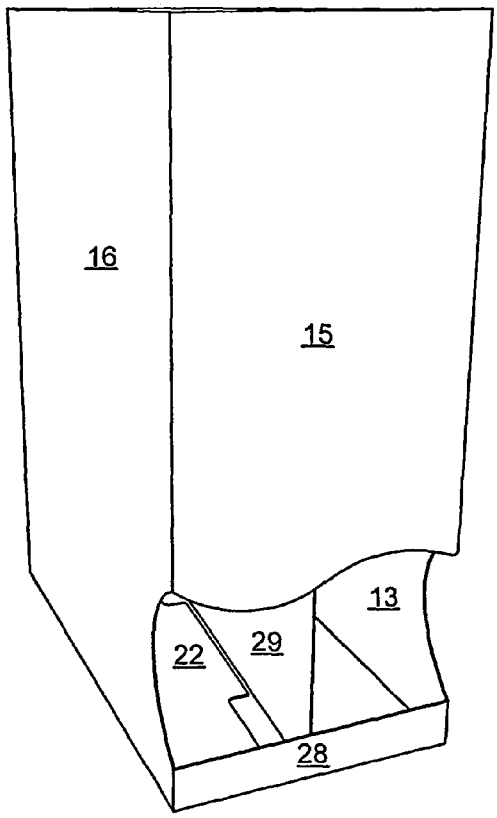
FIG. 8 is another side perspective view of the assembled carton standing on one side with a removable portion removed to define a roll-out aperture.

The carton 12 is thus fully assembled as shown in FIG. 6 and all panels can display product and promotion information, advertising, logos, competition details etc. In store, the carton 12 can be placed on a shelf on its end adjacent the removable portion 33 which faces toward the consumer. This is shown in FIG. 7. Side panel 15 is, therefore, particularly suited to displaying advertising logos and other information. The removable portion 33 is then removed so as to enable consumers to remove the cans 31 through the resulting roll-out dispensing aperture as shown in FIG. 8. The stop wall 28 prevents the cans 31 from rolling out of the carton 12.

The carton 12 can occupy a relatively small horizontal space on the shelf compared to conventional shrink-wrapped trays for cans and can provide significant advertising/information areas, for example on the side panel 15.

Figure 9:
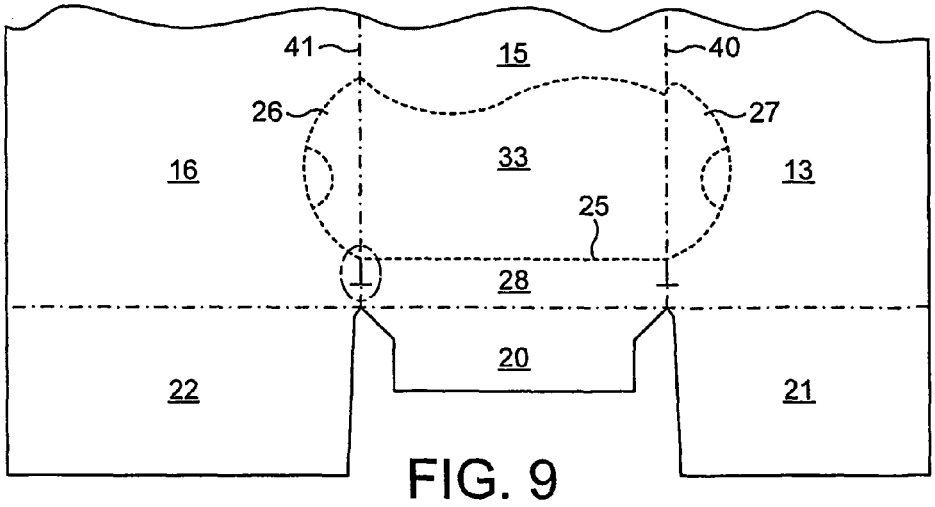
FIG. 9 is an enlarged view of part of a preferred blank for producing a carton according to the present invention.
Figure 10:
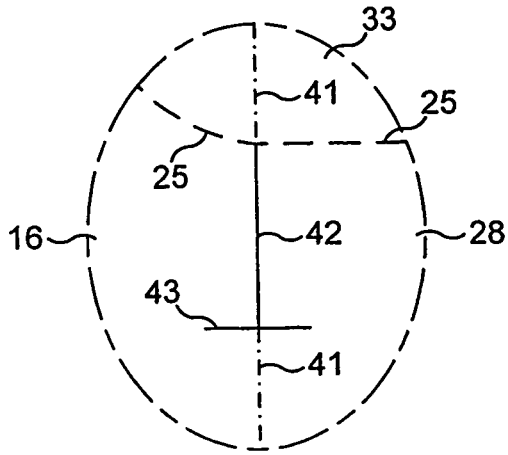
FIG. 10 is a further enlarged view of a detail of FIG. 9.
Figure 11:
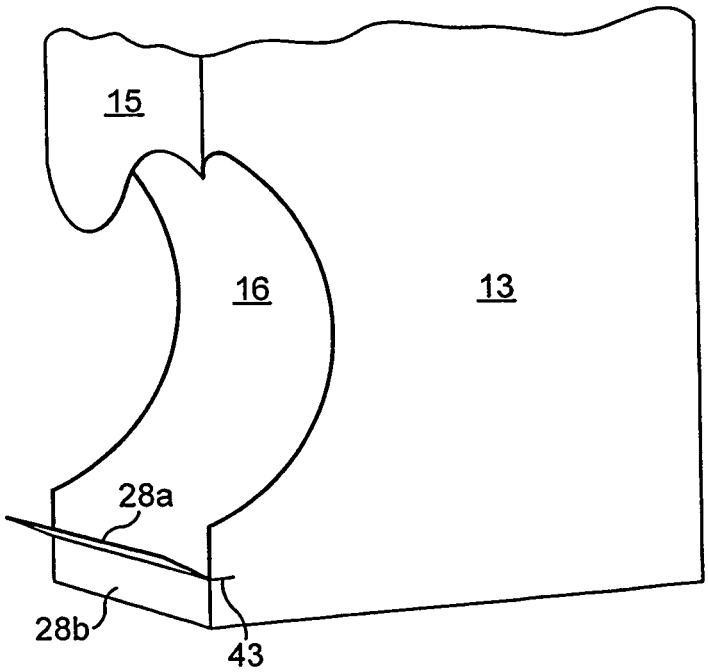
FIG. 11 shows a perspective view during use of the lower part only of a carton assembled using a blank incorporating the FIG. 10 detail.

In FIGS. 9 to 11 there is shown a modification to the abovementioned arrangement. Like parts, however, have been given like reference numerals. Looking at the blank detail in FIGS. 9 and 10, the folds between the side panel 15 and the top panel 13 and the base panel 16 are indicated by numerals 40 and 41 respectively. The line of weakening 25 adjacent the stop wall 28 crosses the folds 40 and 41. The modification is to provide a cut 42 in each fold 40, 41, which cut 42 extends from the line of weakening 25 towards but short of the side end flap 20. A short transverse cut 43 is provided at the end of each cut 42 and the transverse cuts 43 extend a short distance into the stop wall 28 and the base panel 16 or top panel 13 respectively. Between the transverse cuts 43 and the side end flap 20 the folds 40, 41 remain uncut.

The modified blank is assembled in the same way as blank 10 of FIG. 1 and is secured with respect to blank 11 in the same way. Once the pack is opened, however, there is a small difference in operation after the removable portion 33 has been removed. Instead of the entire stop wall 28 being fixed relative to the now upright base and top panels 16, 13, the now upper part 28*a* of the stop wall 28 is able to flex outwardly as illustrated in FIG. 11. The lower part 28*b* of the stop wall 28 remains fixed relative to the base and top panels 16, 13. This outward flexing of the upper part 28*a* is made possible by the provision of the cuts 42 in the folds 40, 41 and makes it easier to remove the cans from the carton. The transverse cuts 43, which are optional, tend to prevent the cuts 42 from extending beyond their intended length towards the side end flap 20.

In this particular embodiment the cuts 42 extend about halfway towards the side end flap 20, but the dimensions are a matter of design choice dependent on the can and other carton dimensions. In addition, although the cuts 42 are shown as extending along the folds 40, 41, alternative cuts could be provided in other locations to facilitate removal of the cans.

It will be appreciated that other products could be packaged in this way, not just cylindrical cans, although cylindrical articles are particularly well suited to the carton. In addition the carton could be modified to accommodate more than two layers of cans, each layer separated by a divider pad which is secured at least to the end panel arrangement adjacent the roll-out aperture and preferably to both end panel arrangements. Other methods of assembly of the finished carton could also be readily envisaged.

While the invention has been disclosed in its preferred forms, it will be apparent to those skilled in the art that many modifications, additions, and deletions can be made herein without departing from the spirit and scope of the invention and its equivalents as set forth in the following claims.

The invention claimed is:

1. A paperboard carton for articles arranged in an end-on-end relationship, the carton comprising:

six sides, the six sides including a first side disposed between a second side and a third side, the first side being perpendicular a fourth side, the second side, and the third side, the second side and the third side being parallel, a two-piece dispenser that includes a first portion and a second portion; the first portion defined at least partially along its perimeter by a first tear line;

the first portion extending at least partially into the first side, the second side, and the third side;

the first portion being removable entirely from the carton along the first tear line; after the first portion is entirely removed from the carton, a first opening for article removal is created; the second portion being adjacent the first portion and being defined at least partially along its perimeter by the first tear line, a first provision, and a second provision; the second portion does not extend into the second side or the third side;

the first provision having a first end proximate the first portion and a second end distal the first portion, the second end of the first provision being intersected by a first intersection line that prevents the first provision from extending beyond its intended length;

the second provision having a first end proximate the first portion and a second end distal the first portion, the second end of the second provision being intersected by a second intersection line that prevents the second provision from extending beyond its intended length;

the second portion being separable along the first provision and the second provision to create a second opening in the carton; and wherein the second opening and the first opening together define an enlarged opening, the enlarged opening enabling easier article removal from the carton than the first opening alone.

2. The carton of claim 1 wherein the first provision and the second provision are parallel.

3. The carton of claim 1 wherein the six sides are arranged substantially rectangular.

4. The carton of claim 1 wherein the first tear line defines a perimeter section of the second portion in the first side.

5. The carton of claim 1, wherein the first and second provisions are cuts.

6. The carton of claim 1, wherein the first and second intersection lines are cuts.

7. The package of claim 6, wherein the first and second provisions are cuts.

8. The package of claim 6, wherein the first and second intersection lines are cuts.

9. The carton of claim 1 wherein the second portion is hingeable at the first intersection line and the second intersection line.

10. The carton of claim 1 wherein the first side and the fourth side intersect at a fold line and wherein the first intersection line and the second intersection line are spaced from the fold line.

11. The carton of claim 1 wherein the first portion is removable from the second portion.

12. A paperboard carton for articles arranged in an end-on-end relationship, the carton comprising:

six sides, the six sides including a first side disposed between a second side and a third side, the first side being perpendicular a fourth side, the second side, and the third side, the second side and the third side being parallel, a two-piece dispenser that includes a first portion and a second portion; the first portion defined at least partially along its perimeter by a first tear line;

the first portion extending at least partially into the first side, the second side, and the third side;

the first portion being removable from the carton along the first tear line to create a first opening for article removal, the second portion being adjacent the first portion and being defined at least partially along its perimeter by the first tear line, a first provision, and a second provision; the second portion does not extend into the second side or the third side;

the first provision having a first end proximate the first portion and a second end distal the first portion, the second end of the first provision being intersected by a first intersection line that prevents the first provision from extending beyond its intended length;

the second provision having a first end proximate the first portion and a second end distal the first portion, the second end of the second provision being intersected by a second intersection line that prevents the second provision from extending beyond its intended length;

the second portion being separable along the first provision and the second provision to create a second opening in the carton; and wherein the second opening and the first opening together define an enlarged opening, the enlarged opening enabling easier article removal from the carton than the first opening alone;

wherein a divider pad is secured to the inside of the carton.

13. The carton of claim 12 wherein the divider pad has a fold down gluing panel.

14. A package comprising:

a plurality of articles;

a paperboard carton for enclosing the plurality of articles in rows, the carton comprising:

six sides, the six sides including a first side disposed between a second side and a third side, the first side being perpendicular a fourth side, the second side, and the third side, the second side and the third side being parallel, a two-piece dispenser that includes a first portion and a second portion;

the first portion defined at least partially along its perimeter by a first tear line;

the first portion extending at least partially into the first side, the second side, and the third side;

the first portion being removable entirely from the carton along the first tear line; after the first portion is entirely removed from the carton, a first opening for article removal is created;

the second portion being adjacent the first portion and being defined at least partially along its perimeter by the first tear line, a first provision, and a second provision; the second portion does not extend into the second side or the third side;

the first provision having a first end proximate the first portion and a second end distal the first portion, the second end of the first provision being intersected by a first intersection line that prevents the first provision from extending beyond its intended length;

the second provision having a first end proximate the first portion and a second end distal the first portion, the second end of the second provision being intersected by a second intersection line that prevents the second provision from extending beyond its intended length;

the second portion being separable along the first provision and the second provision to create a second opening in the carton;

wherein the second opening and the first opening together define an enlarged opening, and the enlarged opening enabling easier article removal from the carton than the first opening.

15. The package of claim 14 wherein the first tear line defines a perimeter section of the second portion in the first side.

16. The package of claim 14 wherein the second portion is hingeable at the first intersection line and the second intersection line.

17. The package of claim 14 the first side and the fourth side intersect at a fold line and wherein the first intersection line and the second intersection line are spaced from the fold line.

18. The package of claim 14 wherein the first portion is removable from the second portion.

19. A blank comprising:

a first panel connected along a first fold line to a second panel;

the second panel connected along a second fold line to a third panel;

the third panel connected along a third fold line to a fourth panel;

at least a first end flap connected to either the first panel, the second panel, the third panel, or the fourth panel along a fourth fold line;

at least a second end flap connected to either the first panel, the second panel, the third panel, or the fourth panel along a fifth fold line; the fourth and the fifth fold lines being parallel, and the fourth and the fifth fold lines being perpendicular to the first fold line;

a first tear line in the third panel, the first tear line intersecting the second fold line at a first intersection point and intersecting the third fold line at a second intersection point;

a second tear line in the third panel, the second tear line intersecting the second fold line at a third intersection point and intersecting the third fold line at a fourth intersection point;

the first tear line and the second tear line being spaced apart a predetermined distance;

a third tear line in the second panel extending approximately from the first intersection point to the third intersection point;

a fourth tear line in the fourth panel extending approximately from the second intersection point to the fourth intersection point;

a first cut extending along the second fold line from the first intersection point to a first transverse cut; and, a second cut extending along the third fold line from the second intersection point to a second transverse cut.

20. The blank of claim 19 wherein the first transverse cut and the second transverse cut are spaced a second predetermined distance from the fifth fold line.

21. The blank of claim 19 wherein the first transverse cut and the second transverse cut are parallel to the fifth fold line.

22. The blank of claim 19 wherein the first transverse cut and the second transverse cut are spaced from the fourth fold line and the fifth fold line.

23. The blank of claim 19 wherein a removable portion is defined by the first tear line, the second tear line, the third tear line, and the fourth tear line, and wherein the removable portion is detachable along the first tear line, the second tear line, the third tear line, and the fourth tear line.

* * * * *